United States Patent [19]

Powell

[11] Patent Number: 4,614,388

[45] Date of Patent: Sep. 30, 1986

[54] CONNECTOR SOCKET FOR PRINTED CIRCUIT BOARDS

[75] Inventor: Francis R. Powell, Naugatuck, Conn.

[73] Assignee: AMP Incorporated, Harrisburg, Pa.

[21] Appl. No.: 818,906

[22] Filed: Jan. 15, 1986

Related U.S. Application Data

[63] Continuation of Ser. No. 681,138, Dec. 13, 1984, abandoned, which is a continuation-in-part of Ser. No. 475,932, Mar. 16, 1983, abandoned.

[51] Int. Cl.[4] ..... H01R 9/09; H01R 13/74; H01R 13/434; H01R 13/187

[52] U.S. Cl. ..... 339/17 C; 24/618; 24/625; 339/128; 339/217 S; 339/221 R; 339/258 R

[58] Field of Search ..... 339/17 C, 126 R, 128, 339/217 S, 221 R, 221 M, 258 R; 24/297, 453, 618, 625; 411/913

[56] References Cited

U.S. PATENT DOCUMENTS 2,192,587 3/1940 Harvey ..... 339/128 X 4,415,212 11/1983 DePillo ..... 339/17 C

*Primary Examiner*—Gil Weidenfeld

*Assistant Examiner*—Steven C. Bishop

*Attorney, Agent, or Firm*—Adrian J. LaRue; Kenneth G. Lehmann

[57] ABSTRACT

A connector socket adapted to be retained in an opening of a printed circuit board to receive a contact pin or the like, has a tubular body portion receivable in the circuit board opening, and has an external shoulder that acts as a stop during the inserting movement. The body portion contains a spring contactor for engagement with any suitable contact pin. For retaining the connector socket securely in the circuit board, it has at least one external resilient spring retainer finger but preferably two fingers which extend lengthwise of the tubular body and engage the circuit board at the opening thereof. The retainer fingers are movable independently of the body, but are formed integrally therewith. The connector socket is constituted as an economical-to-produce metal stamping, which can have very close tolerances, and the body portion has external recesses in which the extremities of the spring fingers are nested, such extremities being inwardly bent to eliminate their interfering with the insertion of the body in the board.

11 Claims, 9 Drawing Figures

CONNECTOR SOCKET FOR PRINTED CIRCUIT BOARDS

CROSS REFERENCES TO RELATED APPLICATIONS

1. Copending Application of Lawrence V. De Pillo filed Sept. 21, 1981 under Ser. No. 06/304,369 and entitled CONNECTOR RECEPTACLE FOR PRINTED CIRCUIT BOARDS, now: U.S. Pat. No. 4,415,212 dated Nov. 15, 1983.

This application is a continuation of my copending application Ser. No. 681,138 filed Dec. 13, 1984, now abandoned, which latter application was a continuation-in-part of my prior application U.S. Ser. No. 475,932 filed Mar. 16, 1983, said latter application having now become abandoned.

BACKGROUND

This invention relates to sub-miniature connector receptacles in the form of small metal shells which are comparable in size to the stem of a small watch and which are fabricated for incorporation in printed circuit boards, in openings provided therein. More particularly the invention relates to receptacles of this type which incorporate friction contact means adapted to cooperate with contact pins of cooperable male connectors, and incorporate spring-type positioning means engageable with the circuit board to effect the proper orientation of the receptacle.

In the past a number of different kinds of connector receptacles of the above type have been proposed and produced. In general these have all been constituted of tubular metal shells that were either drawn or else rolled, and that were provided at their interiors with spring contactors adapted for engagement with the contact pins of cooperable connectors. The tubular shells were utilized by inserting them in openings of printed circuit boards, where they had a sliding fit. The shell side walls were variously formed, as by embossing, stamping and the like, to effect the retention of the shell body in the board after its insertion. Some cups or shells were knurled for this purpose while others were formed with a non-circular cross section. Various and diverse configurations were devised, effected during the fabrication of the metal into the shell or cup form or else thereafter, all to the end that the shell body would be retained in the circuit board after being initially inserted.

A previous construction was characterized by an inner spring contactor having resilient fingers which were folded down alongside the outside of the shell or cup, so as to yieldably engage the edge surfaces of the opening in the circuit board to accomplish the securement. While this operated fairly well, it had the drawback that, sometimes during the wave soldering operation, the solder would travel along the spring fingers and into the inside of the cup or shell, onto the inner spring contactor. This obviously impaired the resilience of the inner contactor, and in many cases rendered it inoperative.

Because of the very large number of connector receptacles that are being utilized in the large quantities of circuit boards finding use at the present time, an important objective is to bring down the cost of the receptacles to the lowest possible figure, especially in view of the competitive nature of the industry. As a rule, these sub-miniature connector receptacles constitute only a very small percentage of the overall cost of the equipment in which they are used.

Another consideration in the manufacture of sub-miniature connector receptacles of the present type, is that they are required to be held to rather strict tolerances, or else the tolerances of the openings in the circuit boards must be carefully chosen and maintained. This latter was difficult to accomplish, and represented an added cost if insisted on. Because of the tolerance considerations, it was found that many shells or cups would only be loosely held and not sufficiently secure when initially placed in the openings of the circuit boards. In other cases, the shells had too tight a fit whereby difficulty was encountered with their insertion, and as well the likelihood existed that damage could occur to the inner resilient spring means whereby the connector was rendered inoperative. With some tight shells, the fit was so difficult to accomplish that the functioning of the inner spring contactor was wholly impossible. Such would be the case where the openings in the circuit board were too small, even if provision was made in the connector to accommodate a wide range of hole diameters.

The configuration of some prior connector receptacles was such that, unless a very accurate alignment of the receptacle was had with the board opening, interference would be encountered during the inserting movement, resulting in damage or at the very least, slowdown at the inserting operation or station.

It was found in the past that the prior working or forming of the shell wall to effect a retention of the shell body was unacceptable additionally for the reason that it tended to restrict the use of the receptacle so that a universal application was not possible. Moreover, the forming of the shell body into special shapes was not desirable because the cost of the connector would be unacceptable due to the special consideration that had to be given to the shell bodies.

SUMMARY

The above drawbacks and disadvantages of prior connector receptacles for printed circuit boards are obviated by the present invention, which has for one object the provision of a novel and improved sub-miniature metal connector receptacle which is comparable in size to the stem in a small watch, and which can be very economically produced while at the same time being easily and quickly insertable in the openings of production-type circuit boards with the least amount of interference, distortion and/or damage to the receptacle, even where commercially-dictated variations exist in the dimensions of the openings provided in such boards.

Another object of the invention is to provide an improved connector receptacle as above set forth, which will be uniformly, securely retained in place after the initial insertion of the receptacle in the board opening.

A still further object of the invention is to provide an improved connector receptacle as above characterized, wherein there is eliminated the likelihood of solder creeping into the inside spring contactor of the receptacle and causing malfunctioning of the same.

Yet another object of the invention is to provide an improved connector receptacle according to the foregoing, which can be readily fabricated as a sheet metal stamping and still held to very precise tolerances, by which the receptacle can be utilized with circuit boards having considerable variations in the openings thereof.

A further object of the invention is to provide an improved connector receptacle in the form of a sheet metal stamping as above described, wherein one or several external resilient spring retainer fingers are provided on the shell or cup body and extend lengthwise thereof so as to cooperate with adjoining surfaces of the circuit board to effectively retain the receptacle in place after its initial insertion, without the likelihood of solder getting into and affecting the inner spring contactor.

A feature of the invention resides in the provision of an improved connector receptacle of the kind outlined, wherein the inserting movement can be easily and quickly carried out without requiring precise alignment, either manually or by suitable automatic or semi-automatic equipment, thereby reducing the overall assembly time of the equipment where it is used.

Another feature of the invention resides in the provision of an improved connector receptacle as above defined, wherein the external spring fingers are movable individually and independently of the receptacle shell or cup and yet can receive a backing-up force which constitutes a reinforcement of the retaining action of the fingers.

In accomplishing the above objects the invention provides a unique receptacle or cup component comprising essentially a tubular body which can easily, slidably fit into openings in a circuit board, and which has an external annular shoulder at its open, mouth portion to constitute a stop for engagement with the circuit board. Disposed in the tubular body is a spring contactor shell which is adapted for engagement with the contact pin of a cooperable, male connector. The tubular cup body has at least one, and preferably two external resilient spring retainer fingers which extend lengthwise thereof, for engagement with the circuit board to maintain the body in the opening thereof against inadvertent dislodgement therefrom, said retainer fingers being movable individually of the body and being integrally formed with the body during a stamping operation. The retainer fingers are joined to the body at the mouth portion thereof and are in the form of a flattened N-configuration. Also, the free ends of the retainer fingers have angular offsets which are disposed closely adjacent an annular external shoulder of the body and in exterior recesses in the shoulder whereby they present no projecting shoulders that could catch on the board surface and obstruct the free and easy insertion of the shell body. In addition, the angular offsets can engage the body to obtain a reinforcement or back-up action for the fingers, which renders their retention function more effective.

The disposition of the spring fingers and their configuration are such as to minimize the likelihood of solder, during the wave soldering operation, creeping into the shell to contaminate the inner spring contactor.

Integral tabs on the cup body are folded inward to effect a positive retention of the spring contactor shell in the body, such tabs being also integrally formed with the body.

Other features and advantages will hereinafter appear:

In the accompanying drawings, illustrating one embodiment of the invention in greatly enlarged scale:

Figure 4:
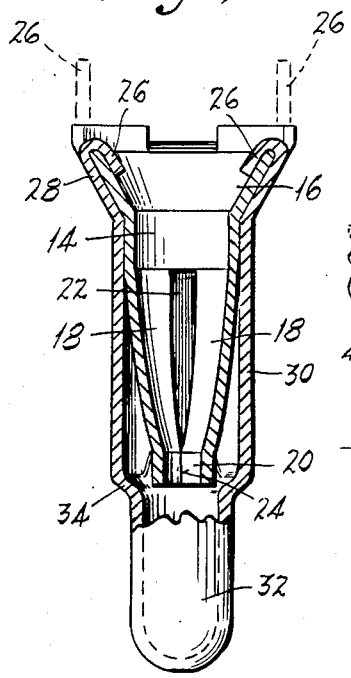
FIG. 4 is a side elevational view of the complete connector receptacle with portions broken away and shown in vertical section to reveal interior details. The sectioning is taken on the line 4—4 of FIG. 3.
Figure 7:
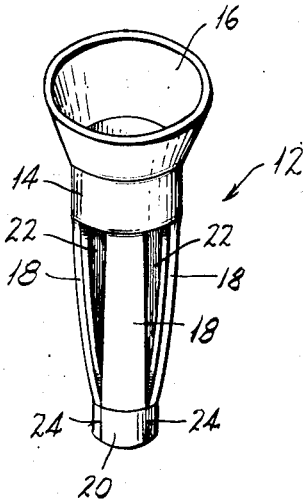
FIG. 7 is a perspective view of the spring contactor shell that is contained in the receptacle body.

As depicted in FIG. 4, the connector receptacle of the invention comprises essentially a two-piece assembly, an outer tubular shell or cup 10 also hereinafter called a tubular metal member or body portion, which is adapted to loosely, slidably fit into an opening of a printed circuit board, and an inner spring contactor member or component 12 (illustrated also in FIG. 7) which is formed separately from the body portion 10 and assembled to it at a later time.

The spring contactor shell 12 comprises a tubular portion 14 having a flared mouth 16, and a plurality of resilient contact fingers 18 that converge from the portion 14 to a yet smaller, tubular formation 20. At the convergence of the contact fingers 18, triangular slits 22 exist, such slits showing as straight line cuts 24 at the tubular formation 20. The contact fingers 18 are thus separate from each other and individually movable, being biased toward the center or axis of the shell to maintain the tubular portion 20 mostly in a closed condition. The contactor shell 12 can fit snugly within the body portion 10 of the receptacle shell or cup at its upper part and is retained therein by a pair of lugs or tabs 26 integral with a flared mouth 28 of the body portion 10, as clearly seen in FIG. 4.

It will be understood that the contactor shell 12 is so mounted that the spring fingers 18 thereof can shift laterally or radially outward an extent to accommodate the larger diameter of a cooperable contact pin or pin terminal which is inserted in the receptacle through the mouth portion 28.

The receptacle body portion 10 is in the form of a deep drawn tubular metal member or shell having in addition to the flared mouth 28, a main tubular body portion 30 which is mostly of smooth cylindrical outer configuration and which is joined to the small diameter of the flare 28, and a lower extremity portion or tip 32 of still smaller diameter, which joins the main body portion 30 and forms an exterior intermediate annular beveled shoulder 34 at the joint. In the appended claims, the body portion 10 is referred to as having a first section (the portion 32), a second section (the portion 30), and a third section (the flare portion 28). During the forming of the shell or cup body 10, the retainer tabs 26 are also blanked out, as will be understood. The exterior diameter of the main body portion 30 of the receptacle 10 is chosen to have an easy sliding fit in openings provided in a printed circuit board 36, such as that shown in broken outline in FIG. 1.

Figure 6:
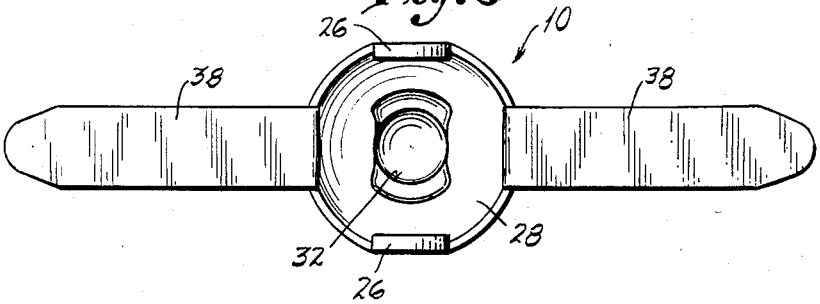
FIG. 6 is a top plan view similar to that of FIG. 5 but showing the spring retainer fingers of the body portion extending laterally, prior to their being folded downward as in FIG. 1.

The receptacle body portion 10 is provided with integral external resilient spring retainer means in the form of fingers 38, two such fingers being illustrated in the drawings and being disposed on opposite sides of the main body portion 30 and extending lengthwise thereof. The spring fingers 38 can be blanked or formed at the same time that the tabs 26 are blanked out, and such forming of the spring fingers 38 preferably occurs after the deep drawing of the body portions 30, 32 has been effected. FIG. 6 illustrates the blanking or formation of the spring fingers 38 initially.

After such blanking of the fingers 38 or during the blanking thereof, the fingers are given a flattened N-configuration forming a bowed section, with a pair of reverse bends 42, 44. Also, the free end portions of the spring fingers 38 have narrowed angular offsets 46 which are adapted to extend closely adjacent the external annular shoulder 34 of the shell 10 after the spring fingers have been folded downward to their ultimate positions as shown in FIG. 1 wherein such offsets are inwardly-turned when the fingers extend along and exterior to the smooth outside cylindrical surface of the main body portion 30 of the shell.

In accordance with the present invention the intermediate annular shoulder 34 is provided with recess means, by being displaced so as to have a pair of oppositely disposed, external semi-circular recesses or indentations 48 in which the narrowed angular offset portions 46 of the fingers are nested and terminate whereby they will not present any shoulder surfaces, other than sloping, beyond the theoretical extensions of the shoulder, which might interfere with the easy insertion of the shell body 10 in the opening of the circuit board. It can be readily understood, when viewing FIG. 1, that if the sharp narrowed inwardly-turned bottom edges of the fingers 38 were to protrude when the receptacle was being inserted in an opening of a circuit board, such sharp protrusions could catch on the board surface and interfere with the proper, easy insertion of the receptacle. While the lower extremity portions of the fingers 38 do present sloping faces, indicated by the numerals 50, which face downwardly, these have a camming action and yield inward easily if they are contacted by the edges of the board opening during the insertion movement. Thus, they do not interfere with the proper insertion, nor is their action such as to require a precise alignment of the receptacle with the board opening upon the insertion occurring. The bottom walls of each recess 48 are flush with and continuations of the exterior surface of the reduced-diameter tip portion 32 of the shell, and the walls of the shoulder 34 on opposite sides of its recess 48 are higher than the extremities 46 of reduced width of the fingers 38. Stated differently, the recesses are formed as indentations in the shell, whereby the recesses have concave outer walls and convex inner walls at the locations of the recesses. The inner walls formed by the indentations protrude inwardly into the bore of the shell at the locations of the recesses. The wall thicknesses of the shell at its main cylindrical body portion, its recesses, and its reduced-diameter tip portion are seen to be essentially uniform or equal.

Figure 1:
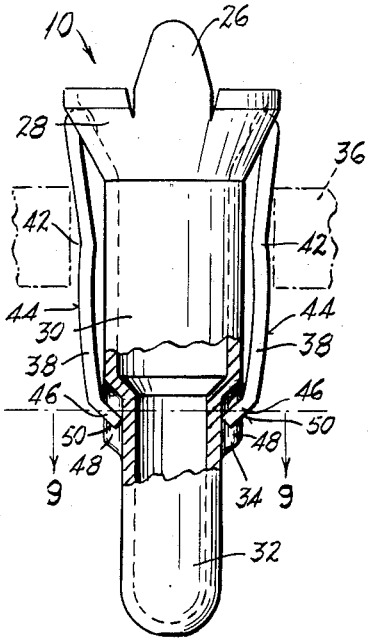
FIG. 1 is a side elevational view, greatly enlarged, of the drawn sheet metal connector body portion of the receptacle having a size comparable to that of the stem in a small watch, with portions broken away and shown in vertical section to reveal interior details. The location of the printed circuit board with respect to the body portion is illustrated by the broken lines.
Figure 2:
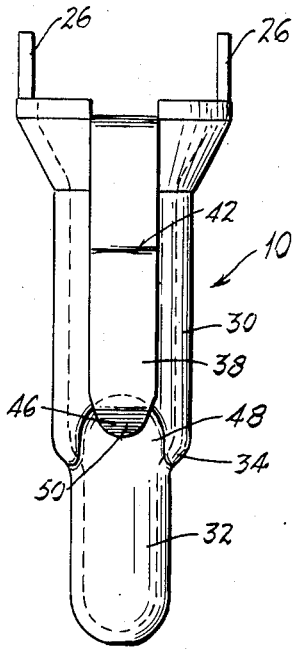
FIG. 2 is a side elevational view of the connector body portion, viewed at an angle of 90° with respect to the viewing of FIG. 1.
Figure 3:
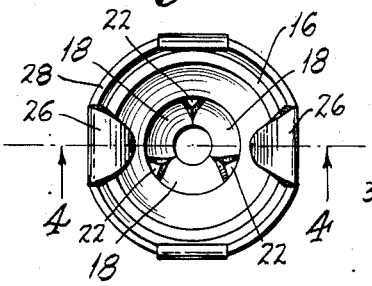
FIG. 3 is a top plan view of the complete connector receptacle.
Figure 5:
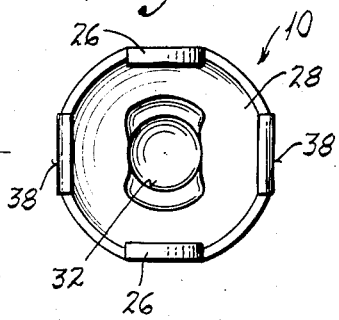
FIG. 5 is a top plan view of the connector receptacle body of FIG. 1.

As seen in FIG. 1, the bottom tips of the fingers can engage the exposed surfaces of the recesses 48 to provide a backup action of the fingers, and engagement can also occur where the bends 42 of the fingers exist, between such bends and the exterior of the shell body 10.

Figure 8:
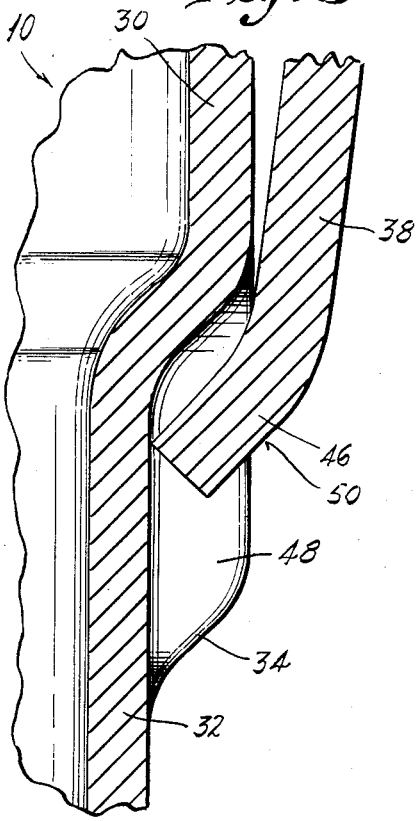
FIG. 8 is a fragmentary sectional view, greatly enlarged, of the right sectional portion of FIG. 1.
Figure 9:
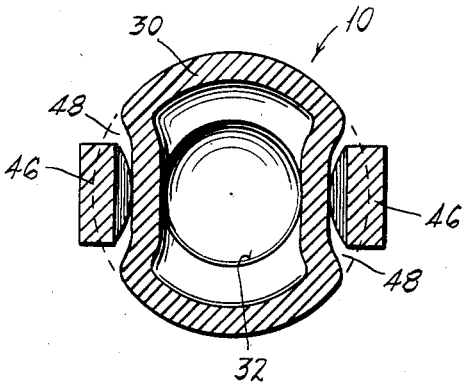
FIG. 9 is a horizontal sectional view, greatly enlarged, taken on the line 9—9 of FIG. 1.

The flattened N-configuration of the fingers 38 represent the bowed flexing portions thereof, these being disposed wholly outside of the recesses 48 and extending along and outside of the smooth exterior cylindrical surface of the main body portion 30 of the shell. The N-configuration also provides external depressions which tend to accommodate the edges of the opening into which the receptacle is inserted, thereby providing a desirable detent action. As can now be readily understood from an inspection of FIGS. 1 and 8, flexing of the fingers 38 which occurs when the receptacle is inserted in the opening of the circuit board 36 results in a slight longitudinal movement of the finger tips 46 in the recesses 48.

By the above construction there is greatly facilitated the quick and easy insertion of the connector receptacle in the opening of the circuit board, with a minimum of interference and without requiring precise alignment of the receptacle at 90° to the board. The likelihood of solder from the wave soldering operation climbing up the fingers 38 and getting inside the shell 10 into the spring contactor 12 is greatly minimized, as contrasted with prior constructions where the resilient fingers that retain the connector receptacle were provided on the spring contactor itself. With these prior constructions, the solder could travel along the spring fingers directly to the spring contactor, where it would flow inside and interfere with the proper functioning of the same.

I have found that with the present construction there is provided a very advantageous, precise and yet economical-to-fabricate connector receptacle adapted for trouble-free insertion in the openings of a printed circuit board. The flare 28 constitutes an external shoulder which provides a positive stop for engagement with the circuit board during the insertion of the receptacle, and the resilient spring fingers 38 engage the circuit board and securely retain the receptacle in the desired operative position without danger of solder being brought into the receptacle to interfere with the necessary spring contact action. There is no longer required the closely-held alignment and tolerances in the openings of the circuit board, and also there is eliminated any malfunctioning during insertion of the receptacle as well as interference with the proper operation of the inner spring contactor shell 12.

The receptacle can be fabricated to very close tolerances in an economical manner whereby it will meet the most exacting requirements and specifications, while at the same time it represents an extremely economical construction.

Variations and modifications are possible without departing from the spirit of the claims.

What is claimed is:

1. An electrical connector receptacle for insertion in an opening of a circuit board for electrical engagement with a pin terminal, comprising:

a tubular metal member having a first section, a second section and a third section, said first section defining an enclosed tip, said second section defining a body of larger diameter than said first section, said third section defining a flared end constituting a stop engageable with the circuit board after the tubular metal member has been inserted in the opening in the circuit board, said flared end also defining a mouth, a beveled shoulder extending between said first and second sections, recess means in said beveled shoulder;

a spring contactor member disposed within said tubular metal member for electrical engagement with the pin terminal;

retainer spring means integral with said third section and extending exteriorly of and along said tubular metal member and having a bowed section for springably engaging a wall defining the opening of the circuit board to retain the receptacle within the opening and an inwardly-turned free end terminating within said recess means so that said inwardly-turned free end is moveable along said recess means and prevented from catching on the circuit board during insertion of the receptacle within the opening.

2. A connector receptacle as set forth in claim 1, wherein said retainer spring means comprises a resilient finger having a free end which is laterally displaced toward the bottom of said recess means with respect to the remainder of the finger.

3. A connector receptacle as set forth in claim 1, wherein said retainer spring means comprises two resilient fingers disposed at opposite sides of the tubular metal member, said tubular metal member having two external recess means disposed respectively adjacent said fingers, in which recess means the free ends of the fingers are nested.

4. A connector receptacle as set forth in claim 1, wherein said retainer spring means comprises a finger having a flattened N-configuration.

5. A connector receptacle as set forth in claim 3, wherein said resilient fingers have a flattened N-configuration.

6. A connector receptacle as set forth in claim 1, wherein the recess means is essentially semi-circular.

7. A connector receptacle as set forth in claim 1, wherein the bottom wall of the recess means is flush with and a continuation of the exterior surface of the said first section of the tubular member.

8. A connector receptacle as set forth in claim 1, wherein the walls of the shoulders on opposite sides of the recess means are higher than the free end of the retainer spring means.

9. A connector receptacle as set forth in claim 1, wherein said tubular metal member is indented to form said recess means whereby it has a concave outer wall and a convex inner wall at the said recess means.

10. A connector receptacle as set forth in claim 9, wherein the inner wall formed by the indentation protrudes inwardly into the bore of the tubular metal member at the location of the recess means.

11. A connector receptacle as set forth in claim 1, wherein the wall thicknesses of the tubular metal member at its second section and at its recess means and its first section are all essentially equal to one another.

* * * * *